US006231044B1

(12) United States Patent
Neary et al.

(10) Patent No.: US 6,231,044 B1
(45) Date of Patent: May 15, 2001

(54) DELIVERY APPARATUS FOR A PRINTING PRESS

(75) Inventors: John M. Neary, Hartland; Karl P. Schaefer, Brookfield; Nick R. Schetter, Rubicon, all of WI (US)

(73) Assignee: Quad/Tech, Inc., Sussex, WI (US)

( * ) Notice: Subject to any disclaimer, the term of this patent is extended or adjusted under 35 U.S.C. 154(b) by 0 days.

(21) Appl. No.: 09/374,779

(22) Filed: Aug. 16, 1999

Related U.S. Application Data

(60) Provisional application No. 60/114,215, filed on Dec. 29, 1998.

(51) Int. Cl.[7] ..... B65H 29/00; B65H 5/34; B41F 1/30; B65G 49/00

(52) U.S. Cl. ..... 271/270; 271/187; 271/315; 101/409; 198/644; 198/715; 198/835

(58) Field of Search ..... 271/187, 315, 271/270; 101/409; 198/644, 715, 478.1, 834, 835, 222

(56) References Cited

U.S. PATENT DOCUMENTS

| | | | | |
|---|---|---|---|---|
| 588,082 | * | 8/1897 | Perlins | 144/222 |
| 1,766,083 | * | 6/1930 | Richter | 271/187 |
| 3,762,697 | | 10/1973 | Bolza-Schunemann | 270/6 |
| 3,894,479 | | 7/1975 | Anikanov et al. | 93/93 M |
| 4,202,268 | * | 5/1980 | Becker | 101/409 |
| 4,373,713 | | 2/1983 | Loebach | 271/303 |
| 4,487,408 | | 12/1984 | Fischer | 271/233 |
| 4,522,387 | | 6/1985 | Leuthold | 271/187 |
| 4,629,175 | | 12/1986 | Fischer et al. | 271/202 |
| 4,792,282 | | 12/1988 | Jordan | 416/176 |
| 4,886,260 | | 12/1989 | Reist | 270/60 |
| 4,886,264 | | 12/1989 | Haensch | 271/229 |
| 4,915,371 | | 4/1990 | Quinton | 271/280 |
| 4,925,179 | | 5/1990 | Breton et al. | 271/187 |
| 5,000,437 | | 3/1991 | Schneider et al. | 271/187 |
| 5,037,367 | | 8/1991 | Breton et al. | 493/423 |
| 5,039,082 | | 8/1991 | Littleton | 271/182 |
| 5,088,719 | | 2/1992 | Kiyota et al. | 271/182 |
| 5,112,033 | | 5/1992 | Breton | 270/47 |
| 5,120,049 | * | 6/1992 | Fischer | 271/315 |
| 5,156,389 | | 10/1992 | Novick | 271/187 |
| 5,180,160 | | 1/1993 | Belanger et al. | 271/315 |
| 5,236,188 | | 8/1993 | Breton et al. | 271/187 |
| 5,249,791 | | 10/1993 | Belanger et al. | 271/182 |
| 5,359,929 | | 11/1994 | Hansen | 101/232 |
| 5,359,930 | * | 11/1994 | Hansen | 101/232 X |
| 5,380,000 | | 1/1995 | Ohno | 271/277 |
| 5,485,992 | | 1/1996 | Albert et al. | 271/299 |
| 5,647,586 | | 7/1997 | Novick et al. | 271/182 |
| 5,730,435 | | 3/1998 | Belanger et al. | 270/52.14 |

FOREIGN PATENT DOCUMENTS 441782 2/1923 (DE) .

* cited by examiner

*Primary Examiner*—Christopher P. Ellis
*Assistant Examiner*—Kenneth W Bower
(74) *Attorney, Agent, or Firm*—Michael Best & Friedrich LLP

(57) ABSTRACT

An improved delivery section of a folder of a printing press in which the bucket assemblies and side guides are adjustable to accommodate varying widths of signatures.

28 Claims, 9 Drawing Sheets

Fig. 12.
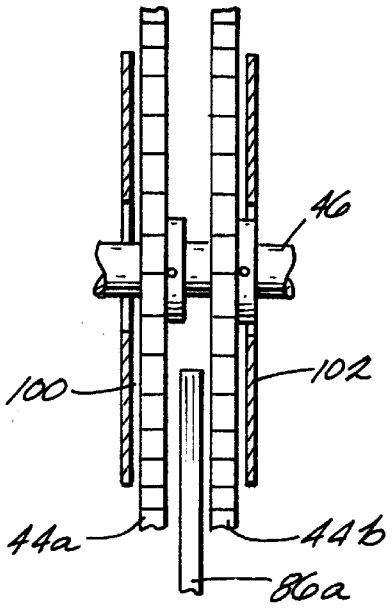
Fig. 13
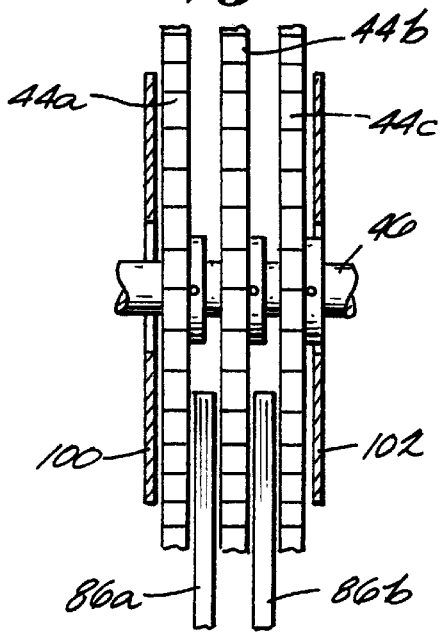
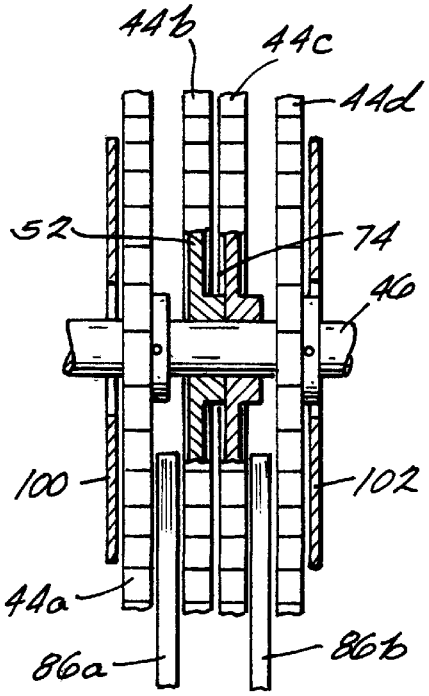
Fig. 14
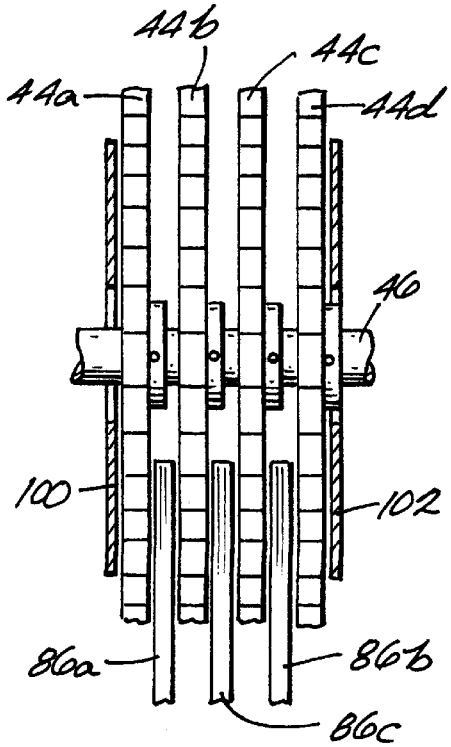
Fig. 15

Fig. 16
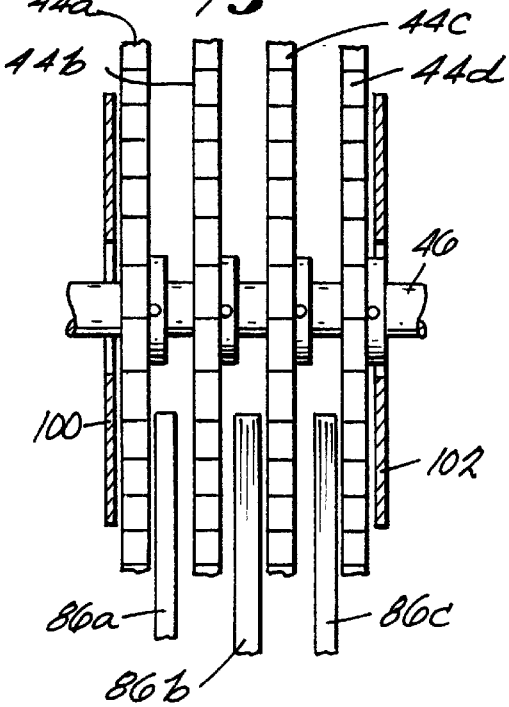
Fig. 17
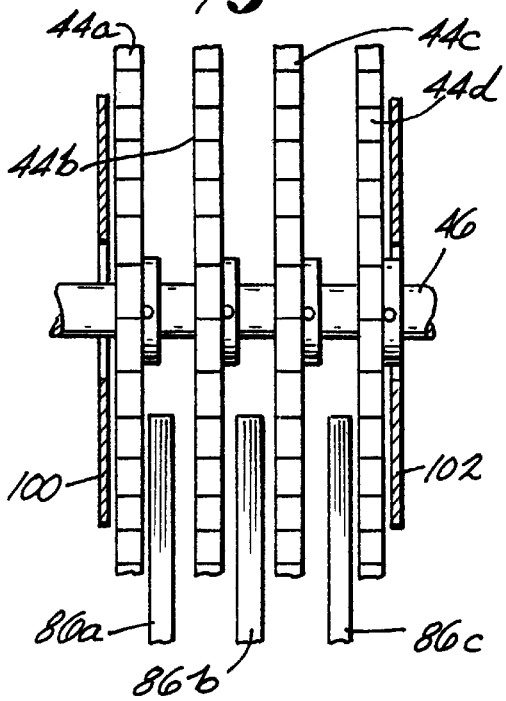
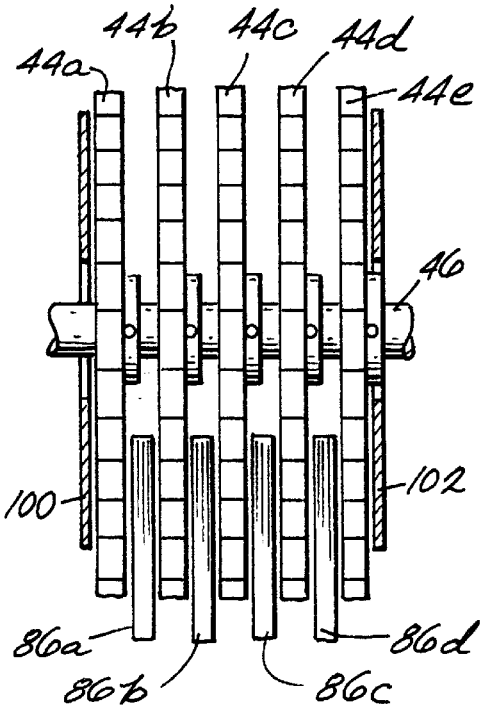
Fig. 18
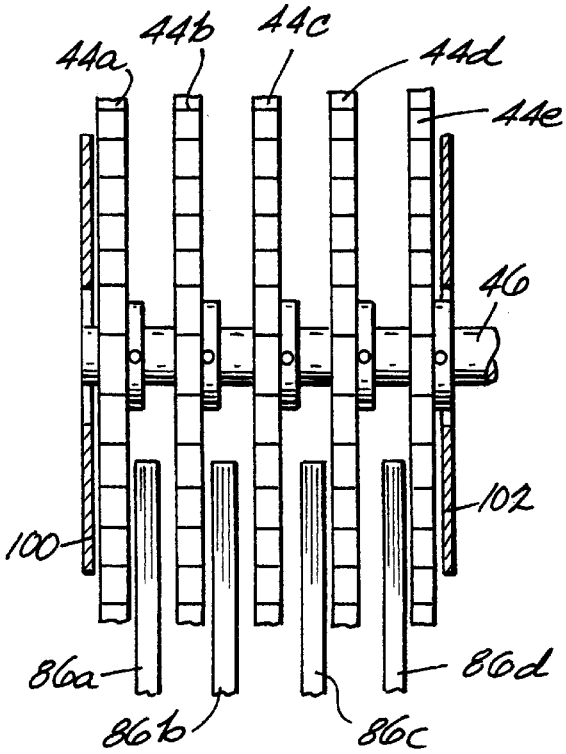
Fig. 19

DELIVERY APPARATUS FOR A PRINTING PRESS

RELATED APPLICATIONS

This application claims the benefit of provisional patent application Ser. No. 60/114,215, filed Dec. 29, 1998.

FIELD OF THE INVENTION

The present invention relates to a delivery apparatus for a folder of a printing press. More particularly, the invention relates to a delivery apparatus that is adjustable to accommodate varying widths of signatures.

BACKGROUND OF THE INVENTION

In the printing industry, a desired image is repeatedly printed on a continuous web or substrate such as paper. In a typical printing process, the continuous web is slit in the longitudinal direction (the direction of web movement) to produce a plurality of continuous ribbons. The ribbons are aligned one on top of the other, folded longitudinally, and then cut laterally to produce a plurality of multi-page, approximately page-length segments, each of which is termed a "signature". The term signature also encompasses a single printed sheet that has or has not been folded. Because more than one different signature can be printed at one time, it is often desirable to separate the different signatures by transporting successive signatures in different directions or paths.

One way to accomplish the sorting of a single stream of signatures is to use a diverter mechanism such as a diverter wedge to divert successive signatures to one of two paths. Once diverted, the signatures typically are transferred to a conveyor using rotating buckets (also known in the art as fans, fan wheels, paddle fans, or rotary flywheels).

A typical configuration includes two sets of rotating buckets assemblies, one set to deliver signatures traveling along a first path to a conveyor and the other set to deliver signatures traveling along the second path to a conveyor. Each set of bucket assemblies includes several buckets arranged at a spaced distance from one another along a common axis or shaft. Each bucket has multiple aligned blades which define pockets or slots between them for receiving signatures and transferring the signature to the conveyor.

It is desirable to increase the operating speed of a printing press in order to increase the printed product output. However, as the rotational speed of the buckets is increased, it is more difficult to ensure the reliable operation of the buckets and ensure that the signatures are not damaged. For example, signature quality problems that can occur at higher press speeds include ink offset, dog-eared edges, and defects to both the leading and trailing edges of the signatures. These and other defects can lead to paper jams in the folder, resulting in press downtime and expense.

It is desirable that the buckets lay the signatures down straight on the conveyor and with evenly spaced shingling so that the stackers can operate efficiently.

It is also desirable that the delivery section of a folder be able to accommodate varying widths of signatures to provide more versatility to the printing in producing its products.

SUMMARY OF THE INVENTION

The present invention provides an improved delivery section of a folder of a printing press. The delivery section is able to obtain faster signature processing speeds than was previously available while minimizing damage to the signatures being processed.

The delivery section of the folder of the present invention includes a bucket assembly. The bucket assembly includes a plurality of buckets spaced from one another along a common axis or shaft. Each bucket includes an improved bucket design which includes a split and nestable hub and a plurality of blades radiating from the hub. The bucket design enables the cooperative buckets of one bucket assembly to be easily adjusted along the shaft to accommodate various widths of signatures, such as from 4" to 12". The bucket assembly provides for adjustability along the common shaft while allowing for room between adjacent buckets for strippers that remove the signatures from the pocket of the buckets.

The delivery section of the folder of the present invention includes an improved side guide assembly. The side guide assembly includes two side guide plates that are adjustable to approximate the width of the signature being processed. One of the side guides can be opened/closed remotely with the use of an air cylinder. A guide for the trailing edge of the signature is also provided.

The buckets and the side guides of the present invention are designed so that the most popular width of signatures (for example, 7.5" to 9") can be run with one set up and does not require having to remove a side guide. For most jobs, all the press operator has to do is to slide the buckets, strippers, and side guides to a new position and lock them down into place.

It is an feature of the present invention to provide an improved delivery section of a folder of a printing press.

It is another feature of the present invention to provide a delivery section that can accommodate varying widths of signatures, such as from 4" to 12".

It is another feature of the present invention to provide for an improved bucket assembly.

It is another feature of the present invention to provide a bucket assembly that is easily adjustable to accommodate various widths of signatures.

It is another feature of the present invention to provide a bucket assembly that includes more than three buckets.

It is another feature of the present invention to reduce the gap between adjacent buckets for all signature widths.

It is another feature of the present invention to reduce the gap between adjacent buckets using narrow buckets.

It is another feature of the present invention to reduce the gap between adjacent buckets using narrow blades.

It is another feature of the present invention to provide a bucket hub that is split and configured to permit close nesting of adjacent bucket hubs.

It is another feature of the present invention to provide a plurality of buckets along a common shaft where buckets unnecessary to process smaller width signatures are moved to a designated portion on the common shaft for storage.

It is another feature of the present invention to reduce damage to the leading edge of the signatures when the signatures hit the end of the bucket slot.

It is another feature of the present invention to provide buckets that can process signatures at faster speeds.

It is another feature of the present invention to provide buckets that are economical to fabricate and easy to assemble.

It is another feature of the present invention to provide buckets that can be removed from the folder for servicing either by sliding the buckets off the end of the bucket shaft or by separating the two bucket halves to free them from the bucket shaft.

It is another feature of the present invention to provide an improved side guide assembly.

It is another feature of the present invention to provide a side guide assembly with a range of adjustment to accommodate signatures of varying widths.

It is another feature of the present invention to provide a side guide assembly that includes a guide that is easily removable and re-positionable between various buckets.

Other features and advantages of the invention will become apparent to those skilled in the art upon review of the following detailed description, drawings, and claims.

BRIEF DESCRIPTION OF THE DRAWINGS

FIG. 12 is a front view of two buckets and one stripper on the bucket shaft;

FIG. 13 is a front view of three buckets and two strippers on the bucket shaft;

FIG. 14 is a front view of four buckets and two strippers on the bucket shaft;

FIG. 15 is a front view of four buckets and three strippers on the bucket shaft;

FIG. 16 is a front view of four buckets and three strippers on the bucket shaft;

FIG. 17 is a front view of four buckets and three strippers on the bucket shaft;

FIG. 18 is a front view of five buckets and four strippers on the bucket shaft; and FIG. 19 is a front view of five buckets and four strippers on the bucket shaft.

Figure 1:
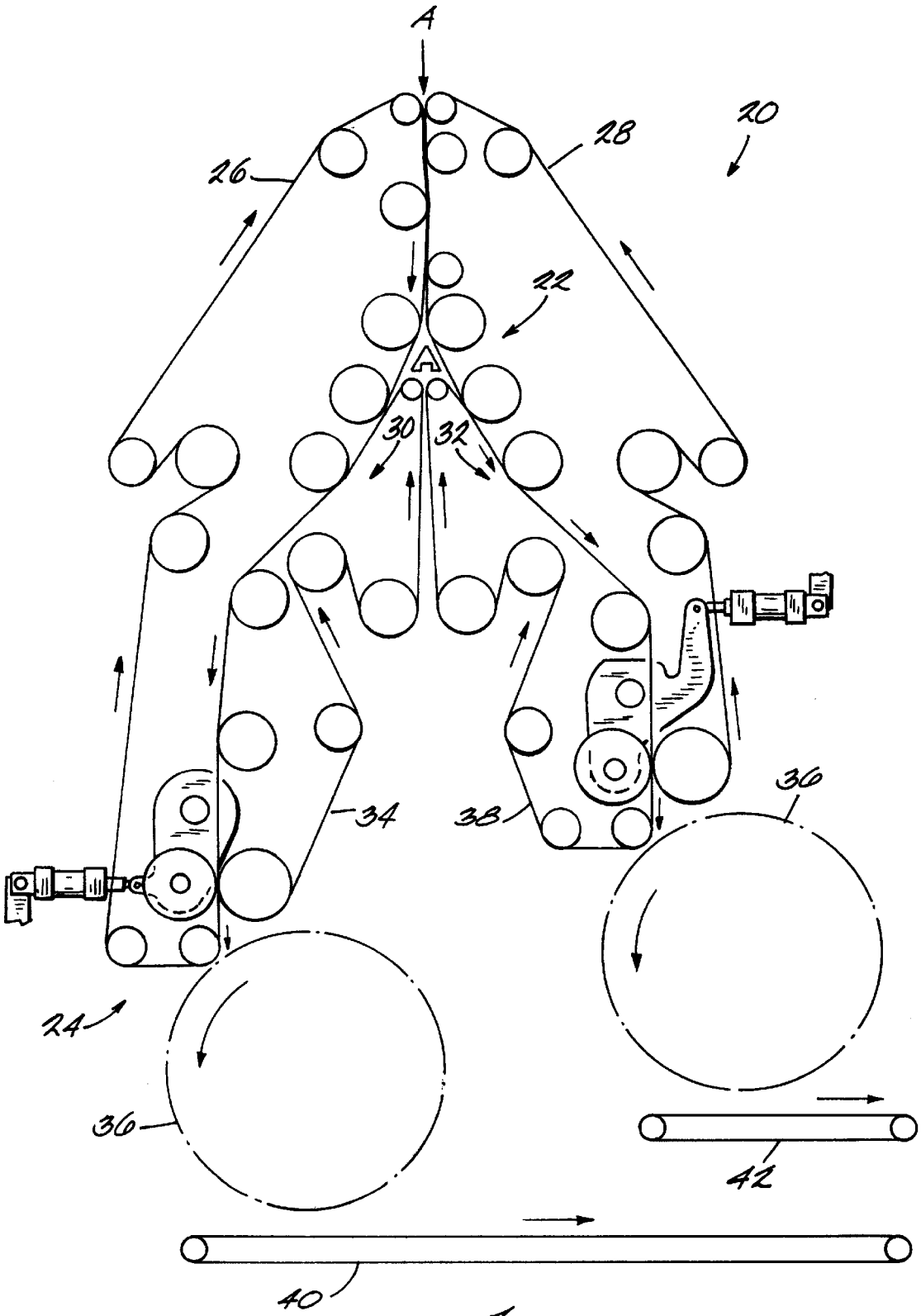
FIG. 1 is a side view of the delivery section of a folder from the diverter area to each of two bucket assemblies.

Before one embodiment of the invention is explained in detail, it is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

BRIEF DESCRIPTION OF THE PREFERRED EMBODIMENT

Illustrated in FIG. 1 of the drawings is a schematic of the delivery portion 20 of a folder of a high speed printing press which includes a diverting section 22 and a bucket section 24. A forming section, a drive section and cutting section of the folder are not shown in FIG. 1. An example of such a high speed printing press is the Harris M3000B web offset printing press. However, it should be noted that the present invention is applicable to other types and models of printing presses, such as sheet fed printing presses.

Successive folded and cut signatures enter the diverting section 22 at the arrow A from the cutting cylinders and are positioned between driven transport tapes 26 and 28. The signatures are diverted into one of two signature paths 30 and 32, most typically the signatures are diverted alternately to path 30 then to path 32.

After being diverted, the signatures enter the bucket section 24 of the folder. Signatures on path 30 are transported between tapes 26 and 34 to a rotating bucket assembly 36 and the signatures on path 32 are transported between tapes 28 and 38 to a rotating bucket assembly 36. The bucket assemblies 36 are only generally shown in FIG. 1. The bucket assembly 36 transfers and slows down signatures diverted along path 30 to a conveyor 40 and the other bucket assembly 36 transfers signatures diverted along path 32 to a conveyor 42. The conveyors 40 and 42 transport the signatures in a shingled stream to an area for accumulation or further processing, such as to a stacker.

Figure 2:
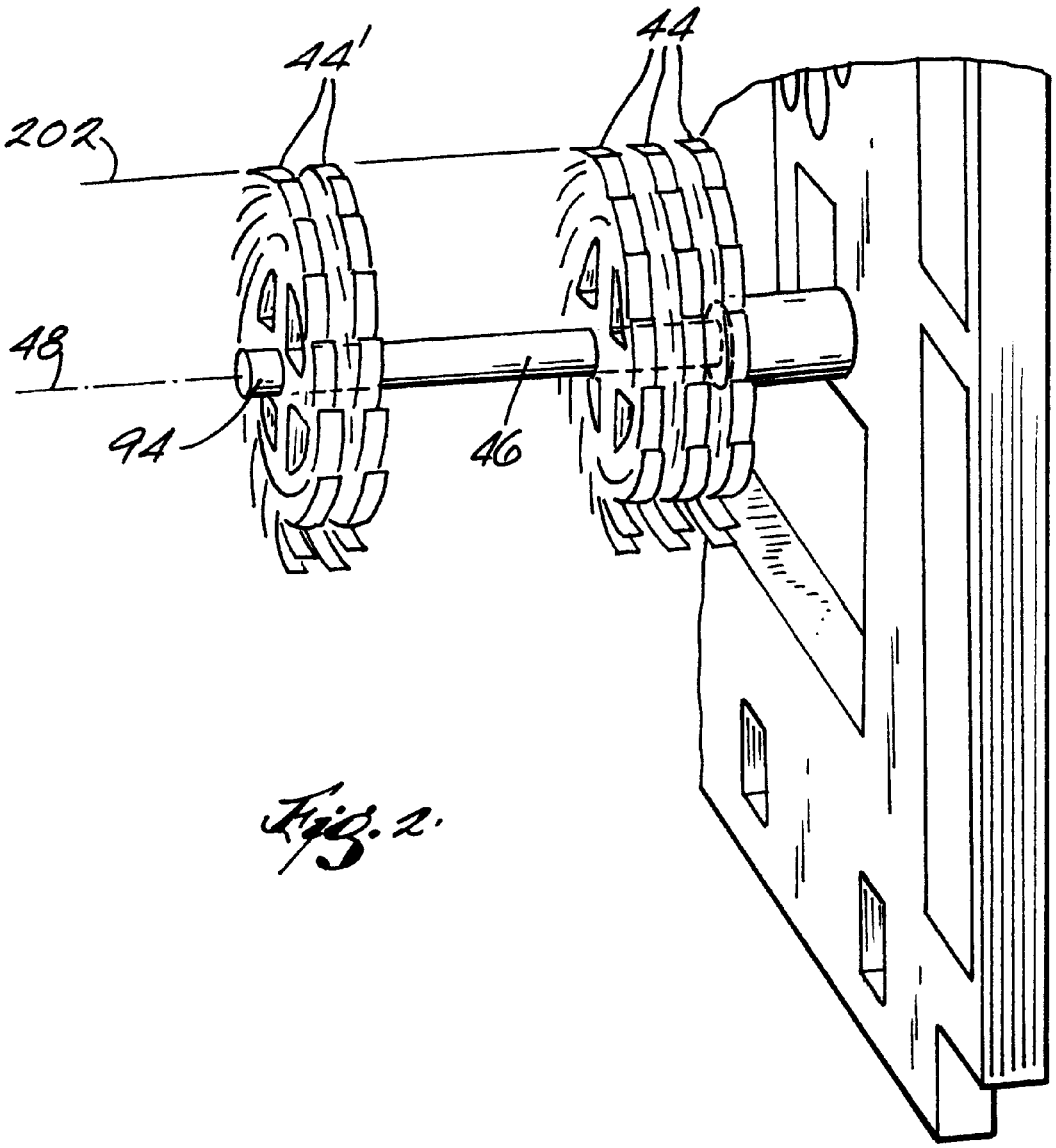
FIG. 2 is a perspective view of a plurality of buckets positioned on a bucket shaft with three buckets in a storage location on the shaft.
Figure 3:
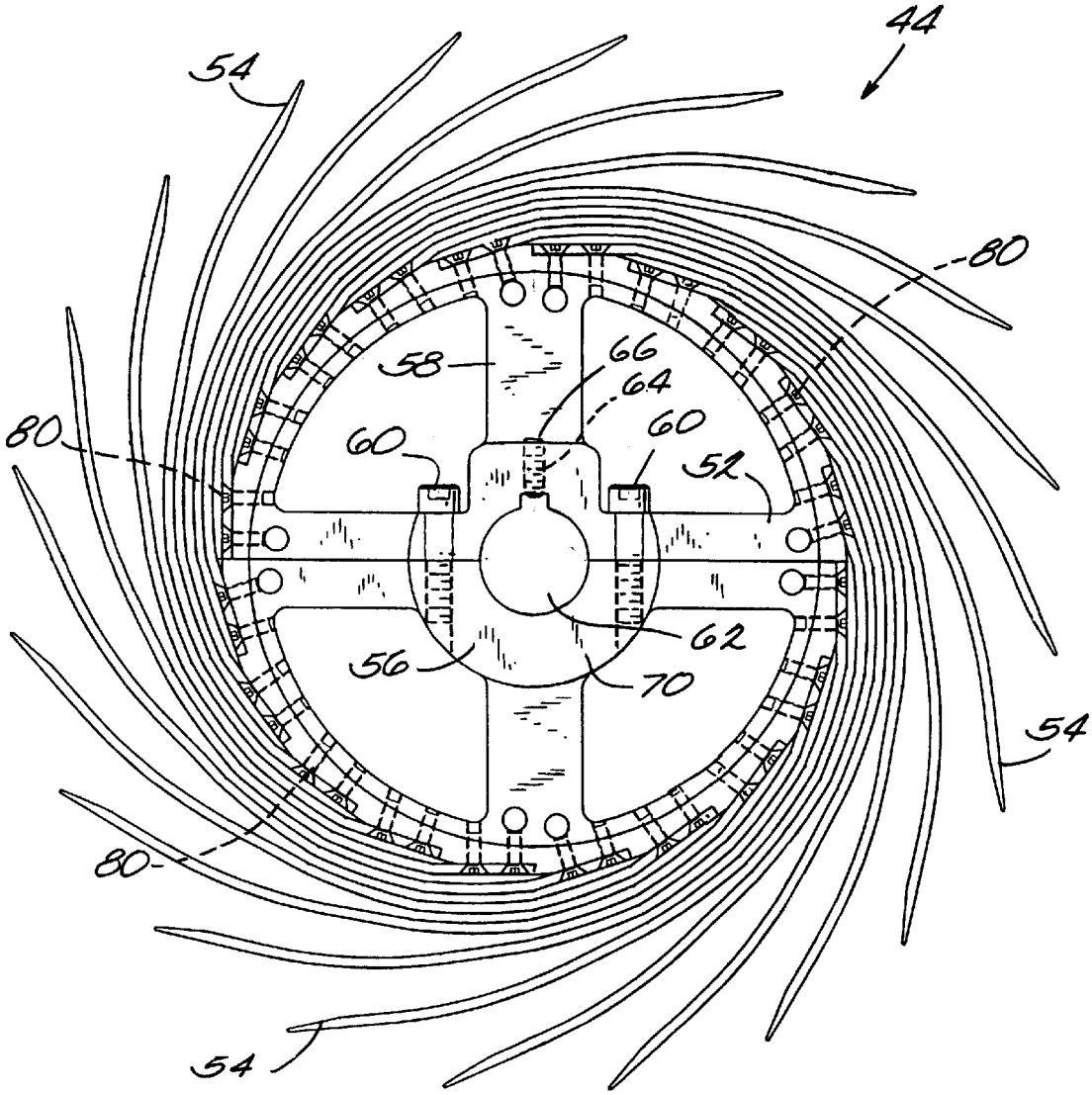
Fig. 3 is a plan view of a bucket embodying the invention.

Referring now to FIGS. 2 and 3, the bucket assembly 36 includes a plurality of buckets 44 mounted on a common bucket shaft 46 having a square key 47 and a longitudinal axis 48. The buckets 44 cooperatively rotate with their common shaft 46 to transfer and slow down signatures to a respective conveyor 40 or 42.

The shaft 46 of each bucket assembly 36 is driven to thus rotate the buckets 44. so that sequential signatures enter the sequential pockets of the aligned buckets. The shaft 46 is driven at a speed to be in phase with the frequency of the signatures arriving and traveling through the bucket section 24. The shaft 46 can be driven by a conventional mechanical motor arrangement. Preferably, each bucket assembly 36 includes its own independently driven, cantilevered from the folder frame shaft 46 that is rotated and controlled by an electric motor, such as a servo motor, such as that shown and described in an application entitled "MOTOR DRIVEN DELIVERY BUCKETS" by inventors Ingermar S. d'Agrella, Nick R. Schetter, John M. Neary, Dennis C. Sopik and Daniel L. Verhaagh filed on Dec. 29, 1998 as Ser. No. 09/222,408, which is herein incorporated by reference.

A single bucket 44 is illustrated in FIG. 3. Each bucket 44 on the common shaft 46 is preferably identical. Each bucket 44 includes a central hub 52 and a plurality of blades 54 extending radially from the hub 52.

Figure 5:
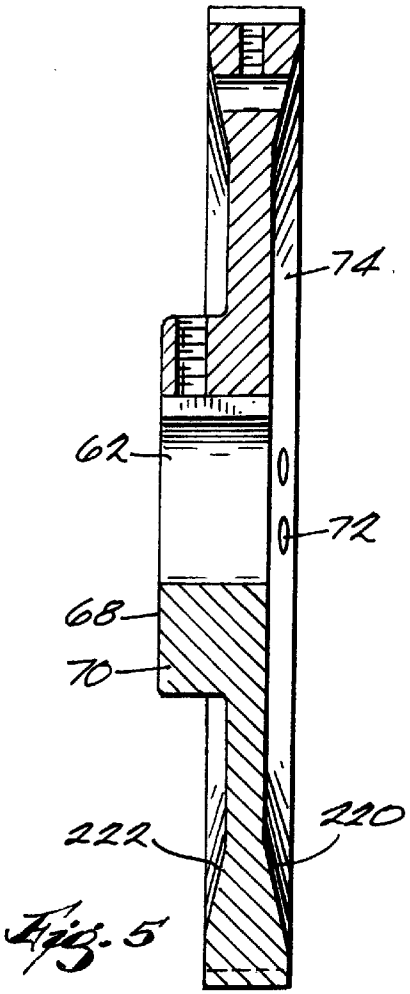
FIG. 5 is a view taken along line 5—5 of FIG. 4.
Figure 4:
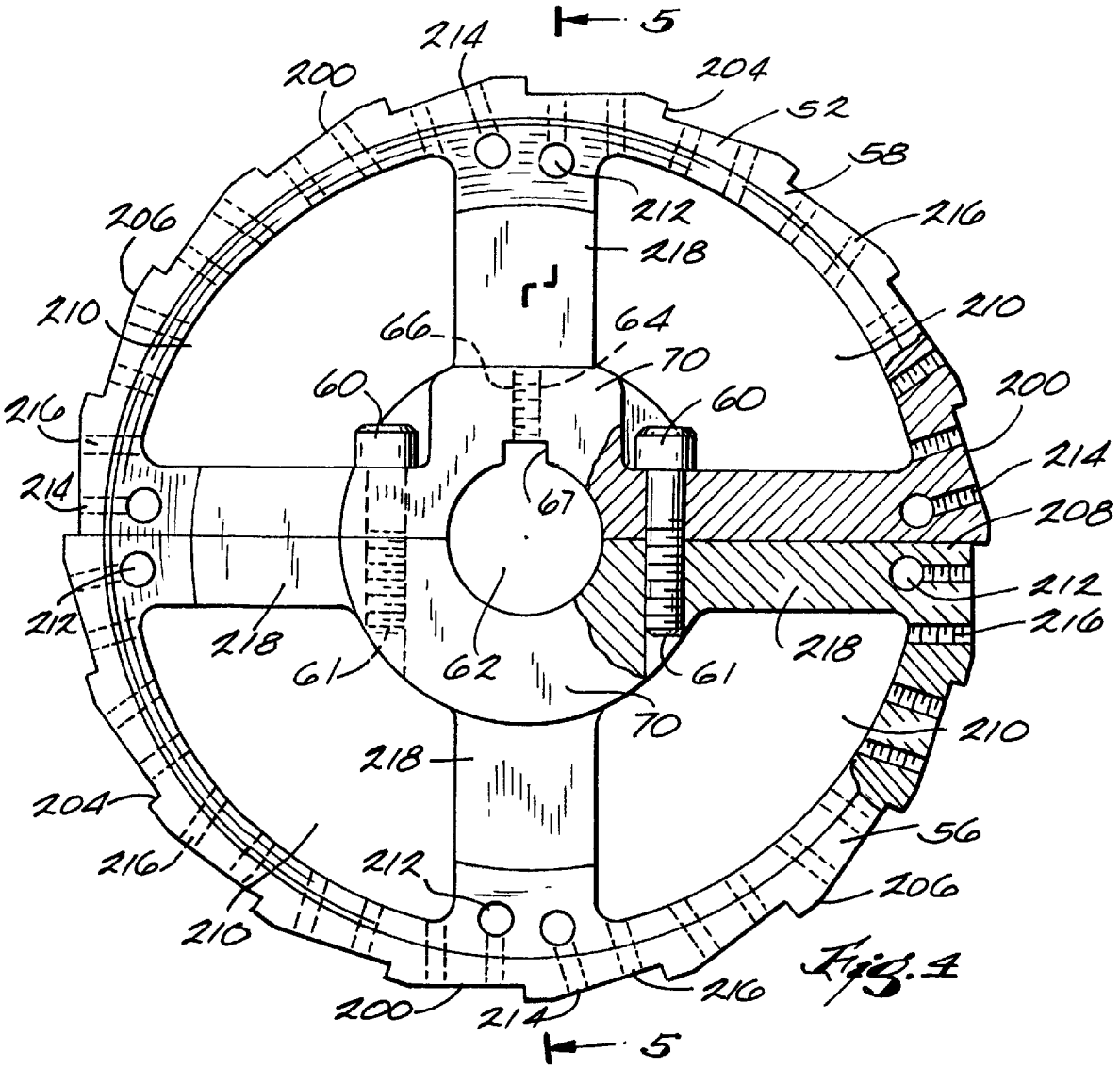
FIG. 4 is a plan view of a hub of the bucket.

As best shown in FIGS. 4 and 5, the hub 52 is preferably two pieces comprised of first hub portion 56 and a second hub portion 58. The hub portions 56 and 58 are preferably fabricated out of a casting made from 6061-T6511 aluminum, however, other materials or other fabrication processes can be utilized. The hub portions 56 and 58 are designed to be secured to one another with bolts 60 in tapped holes 61 and form a generally circular shaft mounting area 62 in the center of the hub 52. Preferably, the screws 60 is a socket head cap screw which includes a hex socket for tightening and loosening the screw 60, however, other types of screws 60, such as self locking screws, could also be used.

The hub portion 58 includes a tapped hole 64 which is designed to house a set screw 66 that secures the bucket 44 to the shaft 46 after each individual bucket 44 has been axially adjusted along the shaft 46 to a desired position. The hub portion 58 includes a keyway 67, which cooperates with the key 47, to prevent rotation of the hub 52 on the shaft 46.

The set screw 66 is easy to access for loosening or tightening when adjusting the axial position of a bucket 44 on the shaft 46. Specifically, the hub portion 58 is designed with the set screw 66 sticking out of the hub 52 so that an operator can see its internal socket better when using a tool to loosen or tighten the set screw 66. Preferably, the set screw 66 is a socket head set screw with cup point for secure gripping to the square key 47 on the shaft 46. Due to the cup point, the set screw 66 digs into the key 47 and does not accidentally rattle loose. Other types of set screws 66 that are suited to this application include soft tipped point set screws and a self-locking set screw, however, many other types of screws could be used.

The hub 52 has a specifically designed profile that enables adjacent hubs 52 to be nested closely together to reduce the gap between adjacent bucket hubs 52 and adjacent bucket blades 54 of adjacent buckets 44. As best shown in FIG. 5, the front face 68 of each hub 52 includes a raised mounting boss 70. A rear face 72 of each hub 52 tapers radially inwardly toward the shaft mounting area 62 to define a recess 74. For example, the recess 74 is 0.25". This tapering enables one bucket 44 to be closely nested to an adjacent bucket 44 in that mounting boss 70 of one bucket 44 can be positioned within the recess 74 of the adjacent bucket 44 (FIG. 14).

More specifically, and with continuing reference to FIG. 4, steps 200 are machined on the outside diameter of both hub portions 56 and 58. A blade 54 is mounted to each step 200. The steps 200 are designed such that, when the buckets 44 are assembled and multiple buckets are mounted to a common shaft 46, the tips of all of the blades 54 should be aligned in one straight line 202 (FIG. 2). Further, the angular spacing of the steps 200 should be accurate so that this alignment of the tips of the blades 54 is consistent all of way around every bucket 44 for each and every blade 54. If one of the blades 54 of any bucket 44 of a bucket assembly 36 is misaligned, a signature could catch on the misaligned blade tip and cause a paper jam or damage to the signature.

Each step 200 includes an end butt 204. Preferably, the height of the end butt 204 is slightly less than the total blade thickness. When a signature slides into a pocket, it comes to rest at a dead end point 206 therefore sliding across the end butt 204. The end butt 204 should be square to the axis of the hub 52 so that when attached to the hub 52, the blades 54 do not stick out crooked to the left or right along the axis 48 of the shaft 46. The hub portions 56 and 58 are joined together along a split line 208. Preferably, the two ends of the split line 208 form two of the end butts 204.

The hub portions 56 and 58 further preferably include four reach-through web _holes 210, eight round clearance holes 212, eight taped holes 214, and thirty two tapped holes 216. Holes 212 are provided so that when the tapped holes 214 are made, the chips can fall out of holes 212. When the tapped holes 216 are made, the drill and chips can go through to the web holes 210. The web holes 210 make the finished bucket 44 lighter and therefore easier to handle and carry. Lighter buckets 44 make the bucket assembly easier to accelerate and decelerate. The holes 210 also provide for better operator access to adjacent buckets 44 on the common shaft 46 and enable the operator to see through the buckets while the folder is running to visually check the signatures using a timing light or strobe. The hub 52 includes four spokes 218 that radiate from the boss 70 that make handling the buckets 44 easier.

Referring now to FIG. 5, the hub 52 includes slanted surfaces 220 and 222. The surfaces 220 and 222 continue around the entire circumference of the hub 52. The surfaces 220 and 222 provides for easier radial access, from the outside diameter of the buckets 44, to screws 60 for adjustment.

Figure 7:
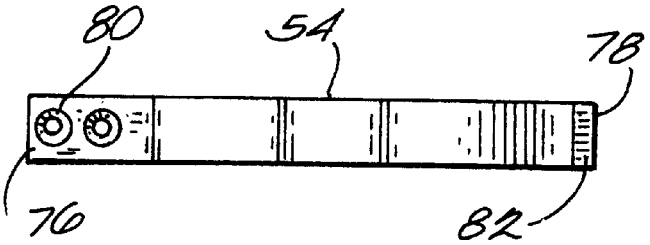
FIG. 7 is plan view of the blade.
Figure 6:
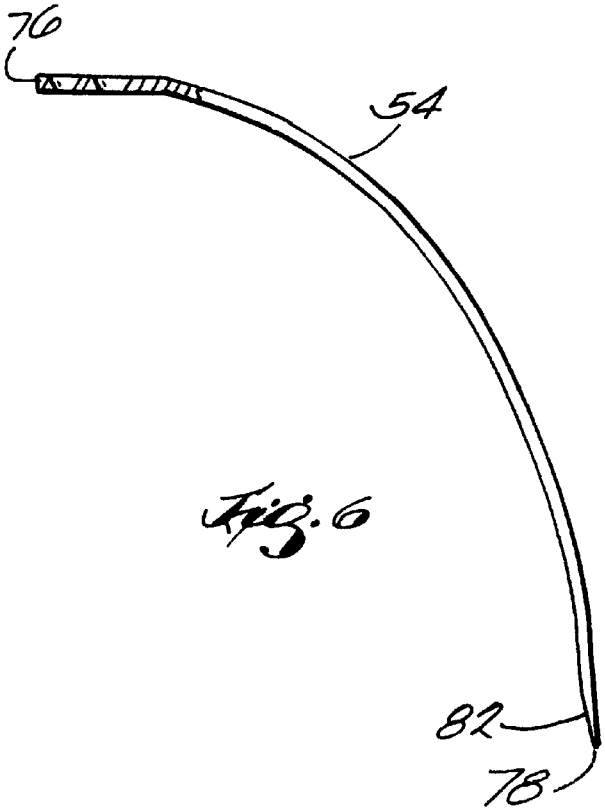
FIG. 6 is a side view of a blade of the bucket.
Figure 8:
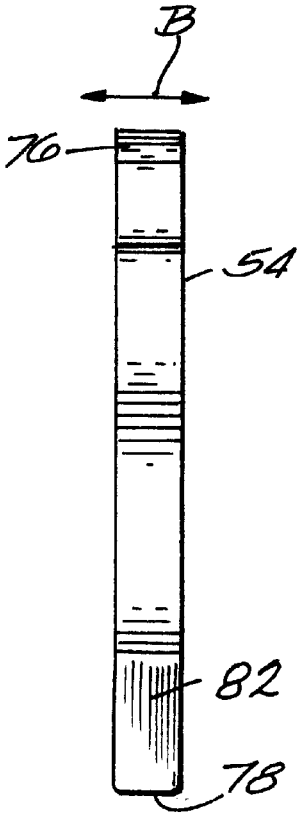
FIG. 8 is a front view of the blade.

Referring now to FIGS. 6–8, the blades 54 are illustrated. Preferably, there are ten blades 54 per hub portion 56 and 58 for a total of 20 blades per bucket, however, other numbers of blades can be employed. Each blade 54 is curved and has a first end 76 and a second end 78. The first end 76 is secured to the steps 200 with two screws 80, preferably flat-head screws, that are inserted into the tapped holes 214 or 216 in each step 200. The second end 78 includes a chamfered tip 82.

Preferably, the blades 54 are fabricated out of steel and are narrower than conventional blades, for example have a width B of 1". Narrower width blades 54 contribute to the overall width of each bucket 44 being narrower. The blades 54 are preferably lined on both sides with teflon pressure sensitive tape to make the blade surfaces very slippery to signatures. It should be noted that differing lengths and curvatures of the blades 54 can be utilized than what is shown in the drawings.

Having narrower buckets 44 allows more buckets to be positioned on the shaft 46 to receive a given width of signature. More buckets 44 for a given signature width enables the gap between buckets 44 to be reduced. A smaller gap leads to signatures being better supported between buckets thereby reducing signature sagging between buckets 44 which can lead to signature damage or bucket malfunction at higher machine speeds.

The improved design of the bucket 44 enables the buckets 44 to be moved closer together so as to minimize the gap between buckets 44. An advantage of the present invention is that the gap between adjacent buckets 44 for a given bucket assembly 36 for all signature widths is kept as small as possible. The smaller the gap, the more support the signatures receive during entry into the bucket slots and during deceleration as the bucket turns during signature delivery to the conveyors 40 or 42, and the less likely the signatures will be damaged. In the preferred and described embodiment for example, using 1" wide blades, the buckets 44 of the present invention can be nested such that there is only a 1" gap between adjacent buckets 44 and adjacent bucket blades 54.

To assemble a bucket 44, and with reference back to FIG. 3, the blades 54 are secured around the periphery of each hub portion 56 and 58 with screws 80. Thereafter, the two hub portions 56 and 58 are secured together with two bolts 60. The hub 52 is made from two halves, hub portions 56 and 58, in order to be able to assemble all of the blades 54 with the screws 80. If the hub 52 were not so split, the first blades 54 would be easy to attach to the hub 52, but nearing the end of the blade attachment, it would be very difficult if not impossible to attach the last blades 54 because the already attached blades 54 would be in the way. Splitting the hub 52 into a plurality of pieces, such as portions 56 and 58, solves this problem.

The assembled bucket 44 is then positioned on the shaft 46 such that the shaft 46 is positioned into the shaft mounting area 62 and the key 47 is in the keyway 67. In other words, the bucket 44 is slid onto the shaft 46. Alternatively, the two hub portions 56 and 58 with blades 54 attached thereto could be positioned around the shaft 46, then secured together With the two bolts 60.

Each bucket 44 of the bucket assembly 36 is slidable along the shaft 46, and in particular along key 47, and securable to the shaft 46 so as to enable the buckets 44 to be adjusted to accommodate differing widths of signatures. After a signature width has been determined and a configuration selected, the folder operator manually adjusts each of the buckets 44 axially along the shaft 46 then locks each bucket 44 into its desired position on the shaft 46 with the set screw 66. The set screw 66 can be reached by the folder operator with a socket wrench extension and a ratchet wrench along the side of the buckets 44.

In order to remove the signatures from the pockets of the buckets 44, stationary strippers 86 are preferably utilized, as are illustrated in FIGS. 12–19. The strippers are adjustable so as to accommodate the various exemplary configurations of FIGS. 12–19, wherein unused strippers 86 are moved to a stripper storage location or completely removed from the folder. The strippers 86 can be conventional strippers that are positionable on a mounting bar and slidably mounted at a spaced distance along the mounting bar.

In the preferred embodiment, the strippers 86 are 0.75" wide, however, strippers of varying dimensions, including wider and narrower strippers, can be utilized with the present invention. For example, narrower strippers 86, such as 0.5" wide, could be utilized to reduce the gap between buckets 44 at various signature widths even more if desired.

Preferably, more than three buckets 44, and more preferably, five buckets 44 are utilized in each bucket assembly 36. However, any other number of buckets 44 can be utilized with the present invention. Hereafter, a bucket assembly 36 utilizing five buckets 44 will be described. With reference to FIG. 2, the blades 54 of each bucket 44 are axially aligned with respective blades 54 on other buckets 44, along line 202 for example, so that the five buckets 44 cooperate to form pockets or slots about their periphery to receive an individual signature. In other words, the blade tips 82 of adjacent buckets 44 are in line because of the alignment of the key 47 of the shaft 46 with the keyway 67 in the hub 52. In the preferred embodiment, with 20 blades 54 extending from each hub 52 of each bucket 44, 20 pockets or slots are formed.

With the present invention, not all five buckets 44 have to be operational to transfer signatures to the conveyor 40 or 42. For example, for smaller width signatures, less than the full five buckets 44 may be required or desired to transfer the signatures from the tapes 26 and 34 to the conveyor 40. In this case, and with reference to FIG. 2, any unused buckets 44' can remain on the shaft 46 but are moved to a storage area 94 on the shaft 46 (i.e. out of the way of the signature path) and locked down to the shaft 46 with the set screw 66. Sliding the unused buckets 44' to a storage area 94 on the shaft 46 has been found to be easier and quicker than entirely removing the unused buckets 44. However, if desired, the unused buckets 44' can be removed entirely from the shaft 46 when the bucket 44 is not being used.

Optionally, the buckets 44 can be fabricated in a right hand version and a mirror image left hand version, for ease of accessing the screws 60 and set screws 66 depending upon how the buckets 44 are oriented on the shaft 46. Preferably, the buckets 44 are installed on the respective shaft 46 such that all of the mounting bosses 70 face toward the middle of the folder where the open end of the shaft 46 is located.

Figure 9:
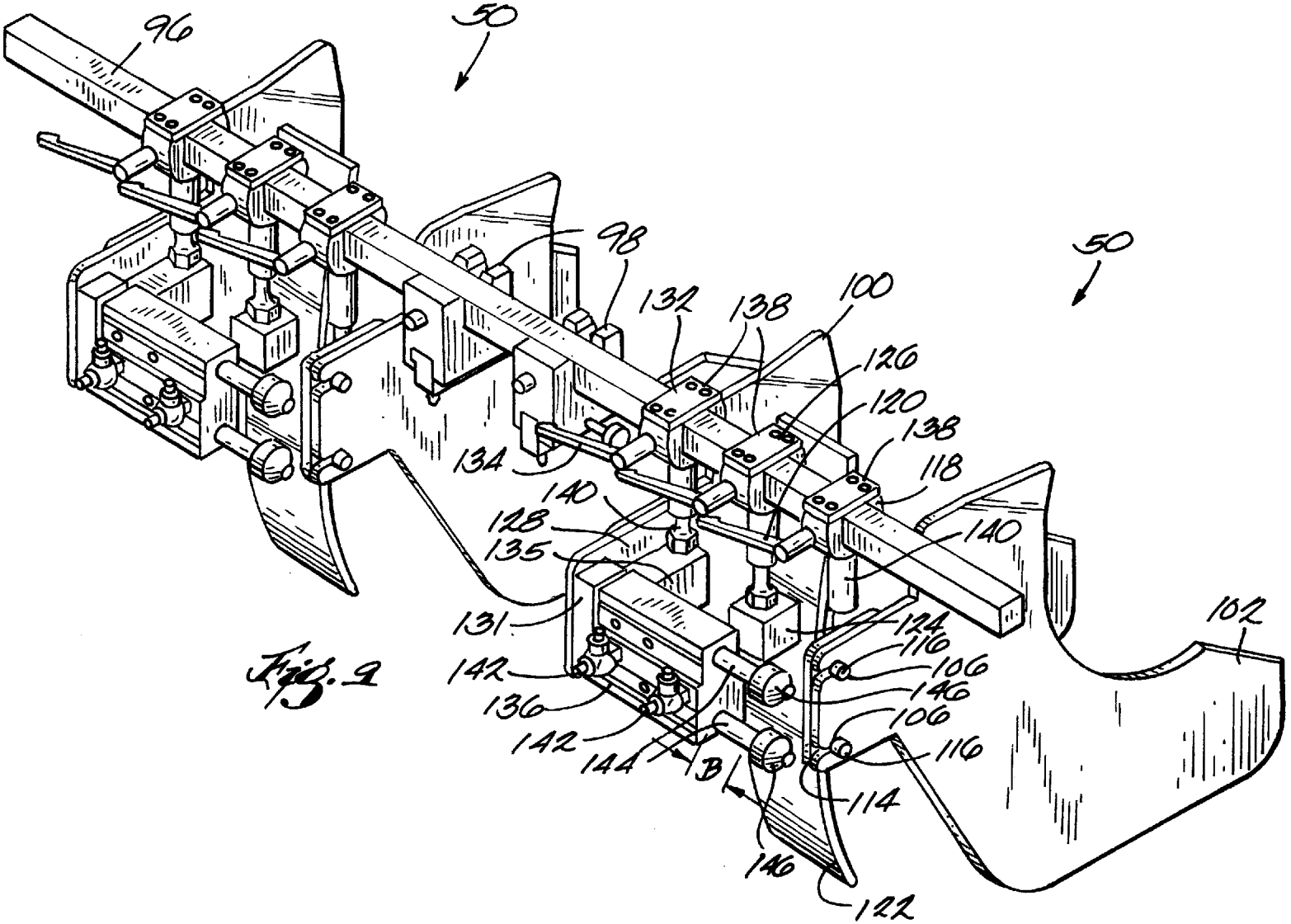
FIG. 9 is a perspective view of the side guide assembly.
Figure 11:
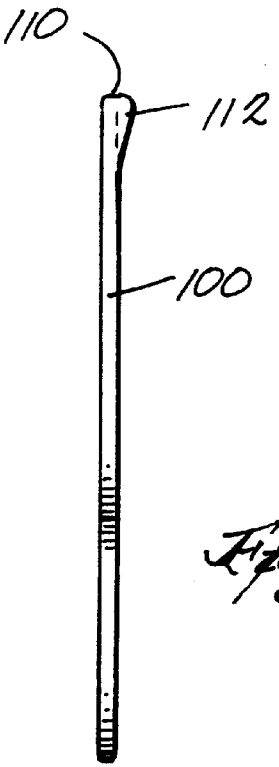
FIG. 11 is a side view of the side guide.
Figure 10:
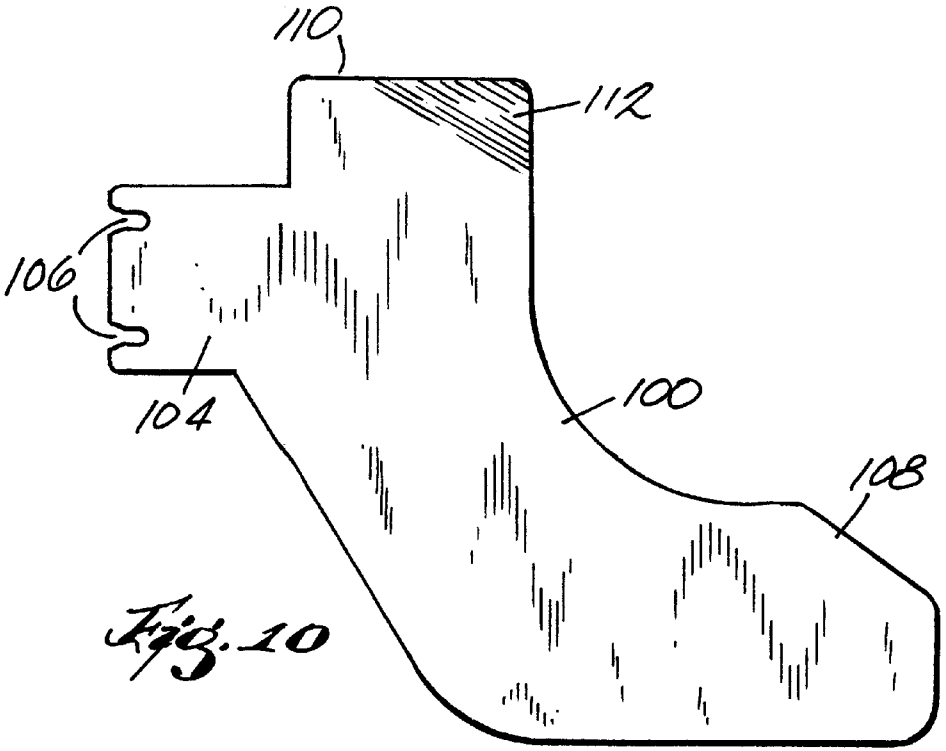
FIG. 10 is a plan view of a side guide.

Turning now to FIGS. 9–11, a signature side guide mechanism 50 is illustrated. The side guide mechanism 50 preferably works in conjunction with the strippers 86 to aid in transferring the signatures into and out of the rotating buckets 44 to the conveyor 40 or 42. In particular, the side guide mechanism 50 guides the side edges of the signatures as the signatures are thrown into the buckets 44 and as the signatures travel down the slots.

The side guide mechanism 50 is designed so it can be adjusted to accommodate and guide signatures of varying widths, such as, for example, widths of 4" to 12", and is designed so as to be operational with a plurality of buckets 44, such as five in the preferred embodiment. Because the side guide mechanism 50 can guide signatures of such varying widths, this allows the folder to run a wider range of signatures widths jobs while minimizing damage to the signatures and still guiding the signatures properly.

With specific reference to FIG. 9, two sets of side guide mechanisms 50 are illustrated on a common, stationary mounting bar 96. The mounting bar 96 is supported by the folder housing and is preferably square in cross-section. The mounting bar 96 includes two support shaft blocks 98 positioned centrally between the two side guide mechanisms 50. The side guide mechanisms 50 illustrated in FIG. 9 are identical and identically assembled on bar 96, therefore only one will be described below.

The side guide mechanism includes a left guide or plate 100 and a right guide or plate 102. The right guide 102 and left guide 100 cooperate to trap and guide a signature therebetween and guide the signature onto the conveyor 40. The left guide 100 is illustrated in FIGS. 10 and 11. The left guide 100 includes a mounting portion 104 having therein two slots 106 and a curved portion 108. The top edge 110 of the curved portion 108 includes an angled tip 112 to better guide the signatures as they enter from above. The left guide 100 has a configuration so as to able it to slide underneath the mounting bar 96 for easy removal or reinsertion into a different position. In other words, the left guide 100 is not too tall to slide underneath the mounting bar 96 which makes position changes of the left guide 100 easier for the folder operator.

The configuration of the left guide 100 has been designed so that where signature guiding is necessary, the guide has a portion to do so, and where guiding is not needed, the guide has been cut away. All of the corners are rounded or chamfered. Preferably, the guide 100 is as small as possible so that it can more easily be maneuvered between buckets 44 while still providing guidance to the signatures.

The right guide 102 is a mirror image of the left guide 100 shown in FIGS. 10 and 11, with the angled tip 112 angled in the opposite direction. The guides 100 and 102 are preferably fabricated from 2024 aluminum which is 0.25" thick and coated with a hard, wear resistant coating, such as Magnaplate HCR, at a surface build-up of 0.002", such that the coating hardness is Rockwell$_c$65–69. The guides 100 and 102 can be made from other materials such as Plexiglas.

Referring back to FIG. 9, the right guide 102 is designed to be removably supported by a guide bracket 114. The guide bracket 114 has thereon two screws 116. The right guide 102 is mounted to the guide bracket 114 by sliding the slots 106 around the screws 116, which are already partially screwed into the guide bracket 114, and tightening the screws 116. To release the right guide 102, the screws 116 are loosened, partially but not entirely, and the right guide 102 is freed from contact with the screws 116. Of course, the screws 116 could be completely removed. Partially loosening the screws 116 insures that the screws 116 do not get dropped or lost. Flat washers and lock washers are preferably used under the screws 116 (not shown). The screws 116 could also be a conventional self-locking screw or the like.

The guide bracket 114 is fixed to a clamping block 118 which includes a handle screw 120. The clamping block 118 is slidably supported by the mounting bar 96, which being preferably square in cross-section, prevents rotation of the clamping block 118 about its axis. To adjust the position of the clamping block 118, and therefore the right guide 102, the handle screw 120 is moved to a release position and the clamping block 118 is freely slidable axially along the mounting bar 96. To secure the clamping block 118 in a desired position, the handle screw 120 is rotated to a lock position which maintains the clamping block 118 in the desired position.

The side guide mechanism 50 preferably also includes a middle guide or plate 122. The middle guide 122 is curved or scooped. The middle guide 122 is fixed to a mounting bracket 124. The mounting bracket 124 is fixed to a clamping block 126, with the clamping block 126 being slidable axially along the mounting bar 96 in the same manner as with the clamping block 118. The purpose of the middle guide 122 is to guide the trailing edge of the signatures as the signatures are ejected out of the rotating buckets 44 by the strippers 86.

Similar to the right guide 102, the left guide 100 is designed to be removably supported by a guide bracket 128. The guide bracket 128 has thereon two screws 130. The left guide 100 is mounted to the guide bracket 128 by sliding the slots 106 around the screws 130, which are already partially screwed into the guide bracket 128, and tightening the screws 130. To release the left guide 100, the screws 130 are loosened, partially but not entirely, and the left guide 100 is freed from contact with the screws 130. The screws 130 can also be entirely removed if desired.

A clamping block 132 which includes a handle screw 134 is slidably supported by the mounting bar 96, which is preferably square in cross-section to prevent rotation of the clamping block 132 about its axis. To adjust the position of the clamping block 132, and therefore the left guide 100 because the elements 140, 135, 136, 131 and 128 are all fastened together as an assembly, the handle screw 134 is moved to a release position and the clamping block 132 is freely slidable axially along the mounting bar 96. To secure the clamping block 132 in a desired position, the handle screw 134 is rotated to a lock position which maintains the clamping block 132 in the desired position.

A mounting bracket 135 extends downwardly from the clamping block 132. An air cylinder 136 is supported by the bracket 135. Two piston rods 144 of the air cylinder 136 are fixed to the portion 131 and the guide bracket 128 is fixed to portion 131. The air cylinder 136 is remotely actuable with electrical solenoids to move the left guide 100 between open and closed positions. The open position is used during start up of the folder. The closed position is used when the folder is finally running optimally.

The air cylinder 136 does not contact the right guide 102 when the left guide 100 and right guide 102 are adjusted for minimum spacing therebetween and does not contact the middle guide 122. The air cylinder 136 can be remotely operated to move the left guide 100 during folder setup and as needed during the actual steady main run of the folder after start up.

The air cylinder 136 includes speed controls and airline connections 142 and the cylinder rear rods 144 with clamping collars 146 thereon. The clamping collars 146 adjust axially on the cylinder rear rods 144 to adjust the stroke of the pistons of the air cylinder 136 and therefore the position of the guide 100. The air cylinder stroke can be adjusted by moving collars 146 to a different location on the two rods 144 that stick out the back of the air cylinder 136. For example, the stroke can be set to ¼", ½", ¾", 1" or the like. The distance B determines the stroke of the air cylinder 136.

The air cylinder 136 moves the left guide 100 in a horizontal direction parallel to the top surface of the conveyor 40 or 42 and away/toward the signatures downward path. The air pressure fed to the air cylinder 136 is remotely adjustable so that the output force of the air cylinder 136 can be adjusted to hold the left guide 100 securely in either the open or the closed position. The air cylinder 136 is preferably a double acting air cylinder with pneumatic speed controls at the two air line ports so the operator can set the speed of opening and closing the left guide 100.

The guides 100, 102 and 122 can be slid off the end of the mounting bar 96 if the buckets 44 are not installed. Otherwise, a top plate 138 can be removed to remove any of the guides 100, 102 and 122 from the mounting bar 96.

Brackets 135, 124 and 114 are all adjustable vertically on the threaded vertical rods 140 and two jam nuts that secure the adjustments. These adjustments are made to make sure the guides 100, 102 and 122 clear the conveyor parts underneath the buckets and guides.

Although both the right guide 102 and the left guide 100 are removable from their respective guide brackets 114 and 128, in operation, typically the right guide 102 is maintained in a preset position and the left guide 100 is the one that is adjusted. To adjust the left guide 100 to between different buckets 44 while the buckets 44 are on the shaft 46, the left guide 100 is removed completely from the guide bracket 128, the clamping block 132 is slid to its new position and locked in place with the handle screw 134, then the left guide 100 is re-secured to the guide bracket 128. The right guide 102 typically guides the backbone (folded) portion of the signature. However, it should be noted that, if desired, both the right guide 102 and the left guide 100 are adjustable to different locations on bar 96 between different buckets 44.

In operation, the left guide 100 can be easily removed via the two slots 106 to reposition the guide 100 between adjacent bucket 44 or on the outside of the last bucket 44 on the shaft 46 for various signature widths. The screws 130 do not have to be completely removed which is an advantage in difficult access spots and dark places. The slot/screw arrangement 106/130 makes moving the left guide 100 to a different position easier and quicker for the folder operator. When the folder operator is setting up the folder for a specific width of signature, in addition to the buckets 44 and strippers 86 being adjusted, the side guide mechanism 50 is also adjusted to guide the width of the specific signature.

Generally, to accommodate and better transfer during deceleration of signatures of varying width to the conveyors 40 and 42, various combinations of number of buckets 44 and number of strippers 86 are utilized as desired or selected by the folder operator. For example, if only four buckets 44 are to be used to transfer signatures, then the one unused bucket 44 would be moved to the storage area 94 on the shaft 46. With respect to the number of strippers 86, the strippers 86 are added or subtracted between adjacent buckets 44 as needed. Preferably, the number of strippers 86 used is one less than the number of buckets 44 in use. As with the unused buckets 44', unused strippers 86' are moved to a storage position on their mounting bar or they are removed entirely from the folder. For a given width of signature being processed, the choice of configuration of buckets 44 and strippers 86 for each bucket assembly 36 is up to the folder operator.

Referring now to FIGS. 12–19, exemplary configurations of buckets 44 and strippers 86 for varying widths of signatures are illustrated. The dimensions given are for the sake of example and should not be regarded as limiting. The following exemplary configurations are based upon a 1' wide bucket blade 54 and 0.75" wide strippers unless otherwise specified.

Specifically, FIG. 12 shows a bucket and stripper configuration for a narrow width signature of at least 4" wide. In this configuration, two buckets 44*a* and 44*b* and one stripper 86*a* are utilized. If a signature of width, for example 4.25", 4.5", 4.75", 5", 5.25", or close to but under 5.5" has to be run, the folder operator can move the left guide 100, spread out the two buckets 44*a* and 44*b* further, and center the stripper 86*a* between the two buckets. This would enlarge the space between the buckets from 1" to 1.25", 1.5", 1.75", 2", 2.25" and 2.5", respectively. As soon as the left and right guides 100 and 102 have been spread out to a distance of 5.5", there is room to insert another bucket and another stripper as is shown in FIG. 13. For some of the above configurations, two narrow strippers (for example 0.5" wide) could also be used instead of one stripper 86*a*.

Turning to FIG. 13, when the signature to be processed by the folder reaches a width of 5.5" or more, then three buckets 44*a*, 44*b* and 44*c* and two strippers 86*a* and 86*b* are used as shown. The space between the buckets (measured between adjacent blades 54) at this minimum width is 1". For signatures wider than 5.5", the left guide 100 is repositioned and the buckets are spread further apart until a dimension of between the side guides 100 and 102 of 6.75" is reached. At that point, the distance between the buckets is 1.625" and there is enough room between the side guides 100 and 102 to add one more bucket as shown in FIG. 14.

Turning to FIG. 14, when the signature reaches a width of 6.75" or more, then four buckets 44*a*, 44*b*, 44*c* and 44*d* and two strippers 86*a* and 86*b* are used. Because of the design of the hub 52, the buckets 44*b* and 44*c* can be nested and therefore moved very close together. For example, FIG. 14 illustrates a 0.25" gap between the two middle buckets 44*b* and 44*c*. This can be accomplished because the hub 52 from the bucket 44*b* has room to nest in the recess 74 of the bucket 44*c*. Because the buckets 44 are narrow, 1" wide where the blade 54 fastens to the hub 52 in the preferred embodiment, an extra bucket can be inserted into this setup at a smaller signature width of 6.75".

Turning now to FIG. 15, when the signature reaches a width of 7.5", the configuration is similar to that in FIG. 14 except the middle two buckets 44*b* and 44*c* have been moved apart by 0.75" which yields enough room so one more stripper 86*c* can be inserted between them.

Turning now to FIG. 16, this configuration is similar to that in FIG. 15 except the buckets 44*a*, 44*b*, 44*c* and 44*d* have been spread apart further by 1.5" to process a signature that is at least 9" wide.

Turning now to FIG. 17, this configuration is similar to that of FIG. 16 except the buckets 44*a*, 44*b*, 44*c* and 44*d* have been spread apart further by another 0.75". The gap between buckets is 1.75".

Turning now to FIG. 18, this configuration is similar to FIG. 17 except another bucket 44*e* and another stripper 86*d* have been added. In this configuration, five buckets 44*a–e* and four strippers 86*a–d* are utilized. This configuration is designed to be used for signature widths between 9.75" and 12".

Turning now to FIG. 19, this configuration is similar to FIG. 18 except the buckets 44*a–e* have been spread out further by another 2.25" to a signature width of 12". The gap between buckets is then 1.625". In these exemplary configuration, signatures widths range from 4' to 12". However, it should be noted that the present invention can be used adapted, as taught herein, to accommodate signatures of widths less than 4" and more than 12".

The configuration of FIG. 15 is used for the majority of signatures being processed through the folder. Most signatures widths fall between 7.5" and 9.0".

We claim:

1. A bucket for a folder of a printing press, said bucket comprising:

a hub having a first portion and a second portion releasably secured to each other, said portions when secured together defining a mounting aperture adapted so that a shaft is positionable in said aperture and so that said hub is rotatable with said shaft, said hub having an axis of rotation, said hub having a first face and a second face, a boss extending axially outwardly from said first face, a recess defined by said second face and tapering radially inwardly and axially inwardly toward said aperture, and said hub being non-symmetrical in any plane perpendicular to said axis of rotation; and a plurality of blades extending radially outwardly from said hub.

2. The bucket of claim 1 wherein said first portion and said second portion are secured to each other with at least one screw positioned through said boss.

3. The bucket of claim 1 wherein said first portion includes a part of said boss and said second portion includes the remainder of said boss.

4. The bucket of claim 1 wherein said first portion includes a part of said recess and said second portion includes the remainder of said recess.

5. The bucket of claim 1 wherein said blades are arcuate.

6. The bucket of claim 1 wherein said aperture includes a keyway adapted to engage a key on the shaft.

7. The bucket of claim 6 wherein said keyway is generally rectangular.

8. The bucket of claim 1 and further including a screw in communication with said hub for engagement with the shaft.

9. The bucket of claim 8 wherein said screw engages the shaft through said boss.

10. The bucket of claim 1 wherein said hub includes an outer annular ring onto which said blades are secured.

11. The bucket of claim 10 wherein said hub includes a plurality of spokes extending radially outwardly from said boss to said ring.

12. The bucket of claim 11 wherein said hub includes at least one generally trapezoidal space radially extending from said boss to said ring.

13. A bucket assembly for a folder of a printing press comprising:

first and second buckets releasably mountable to and selectively positionable along a common shaft, each bucket having a rotation axis, each bucket having an individual width defined by the distance between the farthest point of said respective bucket on one side of said rotation axis to the farthest point of said bucket on the other side of said rotation axis, said buckets positionable on the shaft relative to each other such that the total width of the two adjacent buckets along the shaft is less than the sum of the individual widths of said buckets.

14. The bucket assembly of claim 13 wherein said first and second buckets are identical.

15. The bucket assembly of claim 13 wherein each bucket includes a first portion and a second portion releasably secured together.

16. The bucket assembly of claim 13 wherein each bucket has a first face and a second face, a boss extending axially outwardly from said first face, and a recess in said second face, said recess tapering radially and axially inwardly toward said boss.

17. The bucket assembly of claim 13 wherein each bucket is non-symmetrical in all planes perpendicular to said axis of rotation.

18. The bucket assembly of claim 13 wherein said bucket has an aperture into which the shaft is positionable.

19. The bucket assembly of claim 13 wherein each bucket includes a hub and a plurality of blades extending radially outwardly from said hub.

20. The bucket assembly of claim 19 wherein said hub includes a first portion and a second portion releasably secured together.

21. A bucket assembly for a folder of a printing press, said assembly comprising;

a first bucket adapted to be releasably mounted to a rotating shaft, said first bucket having an axis of rotation and having an outer plane that is defined by a plane that is perpendicular to said axis of rotation and containing the outer most portion of said first bucket; and a second bucket adapted to be releasably mounted to the rotating shaft, and when mounted on the rotating shaft, the second bucket being oriented with respect to said first bucket in that a portion of said second bucket is positionable inwardly of said outer plane in a direction toward the remainder of said first bucket.

22. The bucket assembly of claim 21 wherein said first and second buckets are identical.

23. The bucket assembly of claim 21 wherein each of said buckets include a first portion and a second portion releasably secured together.

24. The bucket assembly of claim 21 wherein each bucket is non-symmetrical in all planes perpendicular to said axis of rotation.

25. The bucket assembly of claim 21 wherein each bucket has an aperture into which the shaft is positionable.

26. The bucket assembly of claim 21 wherein each bucket includes a hub and a plurality of blades extending radially outwardly from said hub.

27. The bucket assembly of claim 26 wherein said hub includes a first portion and a second portion releasably secured together.

28. The bucket assembly of claim 26 wherein each bucket has a first face and a second face, a boss extending axially outwardly from said first face, and a recess in said second face, said recess tapering radially and axially inwardly toward said boss.

* * * * *